US010344508B2

(12) United States Patent
Scarcella

(10) Patent No.: US 10,344,508 B2
(45) Date of Patent: Jul. 9, 2019

(54) HANDLE FOR A DOOR OR WINDOW WITH TWO OR THREE POINT LATCH

(71) Applicant: OPACMARE S.r.l., Rivalta di Turin, Turin (IT)

(72) Inventor: Paolo Scarcella, Turin (IT)

(73) Assignee: OPACMARE S.r.l., Rivalta di Turin (IT)

( * ) Notice: Subject to any disclaimer, the term of this patent is extended or adjusted under 35 U.S.C. 154(b) by 802 days.

(21) Appl. No.: 14/820,399

(22) Filed: Aug. 6, 2015

(65) Prior Publication Data

US 2016/0040459 A1 Feb. 11, 2016

(30) Foreign Application Priority Data

Aug. 8, 2014 (IT) ..... TO2014A0649

(51) Int. Cl.
*E05C 3/16* (2006.01)
*E05B 65/00* (2006.01)
(Continued)

(52) U.S. Cl.
CPC ..... *E05C 3/16* (2013.01); *E05B 7/00* (2013.01); *E05B 65/0025* (2013.01);
(Continued)

(58) Field of Classification Search
CPC ..... Y10S 292/46; Y10T 292/0828; Y10T 292/0825; Y10T 292/0803; Y10T 292/0853; Y10T 292/0911; Y10T 292/0917; Y10T 292/0946; Y10T 70/5173; Y10T 292/0921; Y10T 292/0945; Y10T 292/1076; Y10T 292/0848;
(Continued)

(56) References Cited

U.S. PATENT DOCUMENTS 2,570,160 A 10/1951 Schoch
3,953,061 A 4/1976 Hansen et al.
(Continued)

FOREIGN PATENT DOCUMENTS

EP 1 321 613 A2 6/2003
EP 2 267 253 A2 12/2010
(Continued)

OTHER PUBLICATIONS

Italian Search Report of Italian Patent Application TO2014A000649 dated Apr. 23, 2015.

*Primary Examiner* — Mark A Williams

(74) *Attorney, Agent, or Firm* — Arent Fox LLP; Michael Fainberg

(57) ABSTRACT

A latching system for a door or window that includes a first snap stop member adapted to be arranged at a side edge of a leaf of the door or window, the first stop member includes a pawl rotatable about an axis perpendicular to the plane defined by the leaf; a second snap stop member adapted to be arranged at an upper edge of the leaf, the second stop member comprising a pivot translatable in a vertical direction; a handle rotatable so as to control the releasing movement of the first and second stop members, the handle being rotatable about a horizontal axis parallel to the plane defined by the leaf; and a first and a second transmission mechanism for converting a rotation of the handle into a rotation of the pawl and a translation of the pivot, respectively.

6 Claims, 12 Drawing Sheets

(51) Int. Cl.
*E05B 65/08* (2006.01)
*E05B 7/00* (2006.01)
*E05C 9/00* (2006.01)

(52) U.S. Cl.
CPC ..... *E05B 65/0811* (2013.01); *E05B 65/0876* (2013.01); *E05C 9/002* (2013.01)

(58) Field of Classification Search
CPC ..... Y10T 292/0857; Y10T 292/0922; Y10T 292/0929; Y10T 292/0807; Y10T 292/081; Y10T 292/0844; Y10T 292/0849; Y10T 292/0862; Y10T 292/0887; Y10T 292/1015; Y10T 70/5252; E05B 65/0858; E05B 65/0811; E05B 65/1006; E05B 59/00; E05C 9/1875; E05C 3/34; E05C 9/10; E05C 3/30
USPC ..... 292/195, 4–11, 24–31, 44–52, 56–69, 292/95–129
See application file for complete search history.

(56) References Cited

U.S. PATENT DOCUMENTS

| | | | |
|---|---|---|---|
| 2003/0226384 | A1 | 12/2003 | Shedd et al. |
| 2005/0229657 | A1 | 10/2005 | Johansson et al. |
| 2008/0001413 | A1 | 1/2008 | Lake et al. |
| 2008/0258475 | A1 | 10/2008 | Chung et al. |

FOREIGN PATENT DOCUMENTS

| | | | |
|---|---|---|---|
| EP | 2 733 286 | A2 | 5/2014 |
| WO | WO 96/25576 | A1 | 8/1996 |

HANDLE FOR A DOOR OR WINDOW WITH TWO OR THREE POINT LATCH

CROSS-REFERENCE TO RELATED APPLICATION

This application is a U.S. Patent Application which claims priority to Italian Patent Application No. TO2014A000649, filed Aug. 8, 2014, the disclosure of which is incorporated in its entirety herein by reference.

TECHNICAL FIELD

The present invention relates to doors or windows intended to furnish openings formed in the walls of rooms, in particular rooms on-board a boat.

SUMMARY OF THE INVENTION

In particular, the invention relates to a latching system for a door or window, characterized in that it comprises a first snap stop member adapted to be arranged at a side edge of a leaf of the door or window, said first stop member comprising a pawl rotatable about an axis perpendicular to the plane defined by the leaf, a second snap stop member adapted to be arranged at an upper or lower edge of the leaf, said second stop member comprising a pivot translatable in a vertical direction, and a handle rotatable so as to control the unlatching movement of said first and second stop members, said handle being adapted to be arranged at the side edge of the leaf and being rotatable about a horizontal axis parallel to the plane defined by the leaf, and a first and a second transmission mechanism for converting a rotation of the handle into a rotation of the pawl and a translation of the pivot, respectively.

Preferred embodiments of the invention are defined in the dependent claims which form an integral part of the present description.

BRIEF DESCRIPTION OF THE DRAWINGS

Further characteristic features and advantages of the present invention will become clear from the following detailed description provided purely by way of a non-limiting example, with reference to the accompanying drawings in which.

DESCRIPTION OF THE PREFERRED EMBODIMENTS

Figure 1:
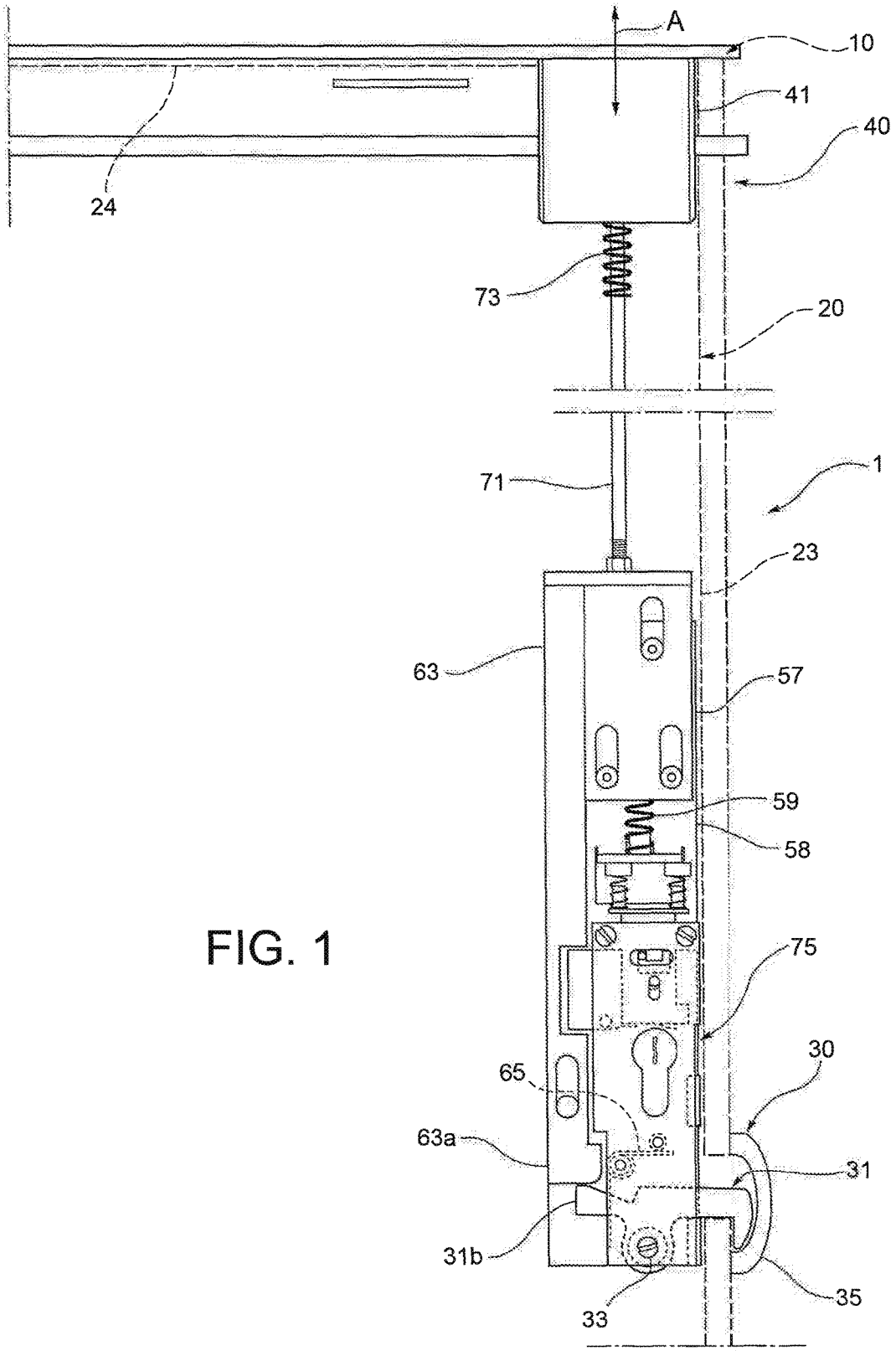
FIG. 1 is a partial view of a door provided with a two-point latching system according to the invention.
Figure 2:
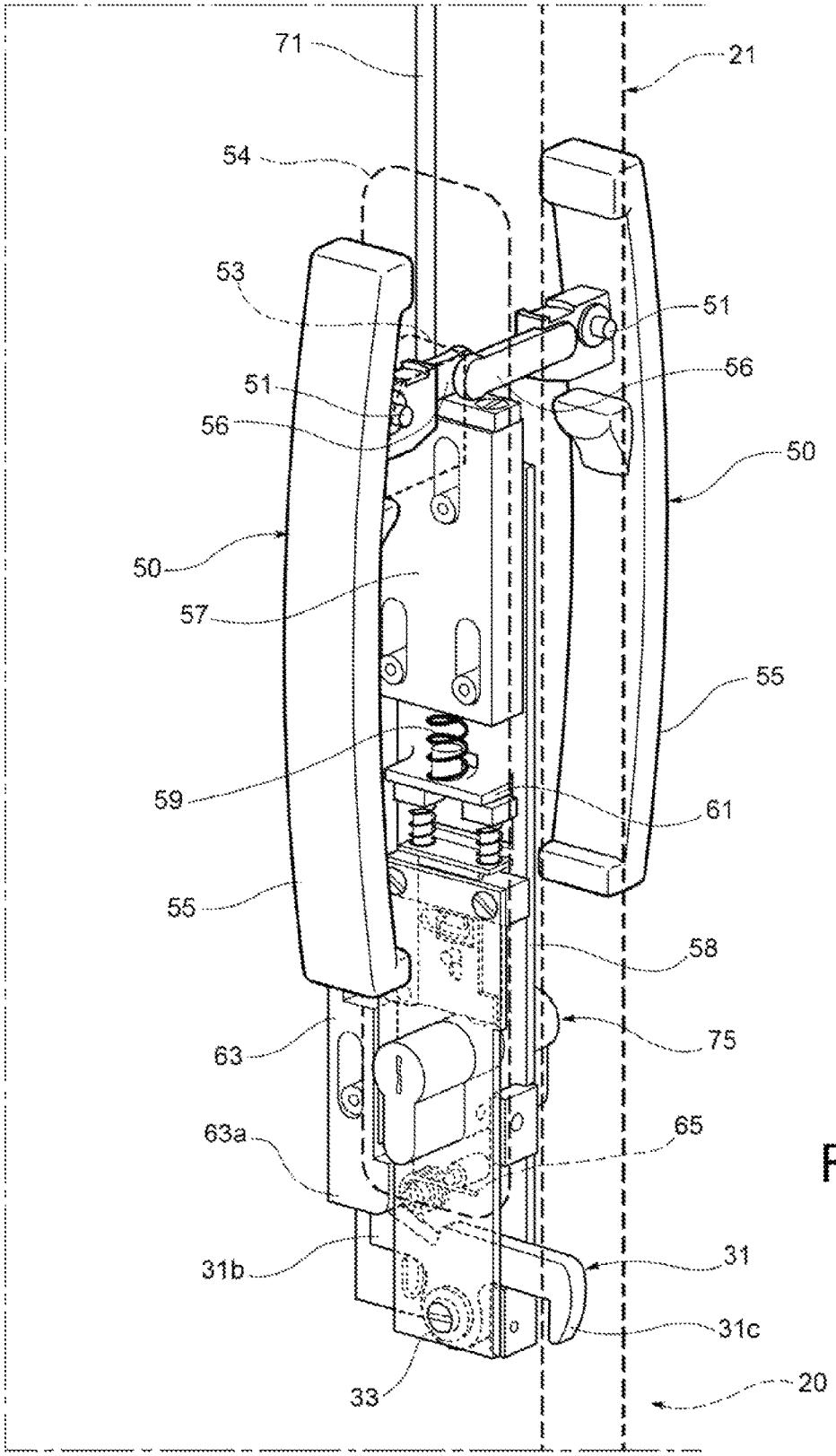
FIGS. 2 and 3 are perspective views of the actuating block of the latching system according to FIG. 1, complete with and without the handles, respectively, in the released handle position.
Figure 3:
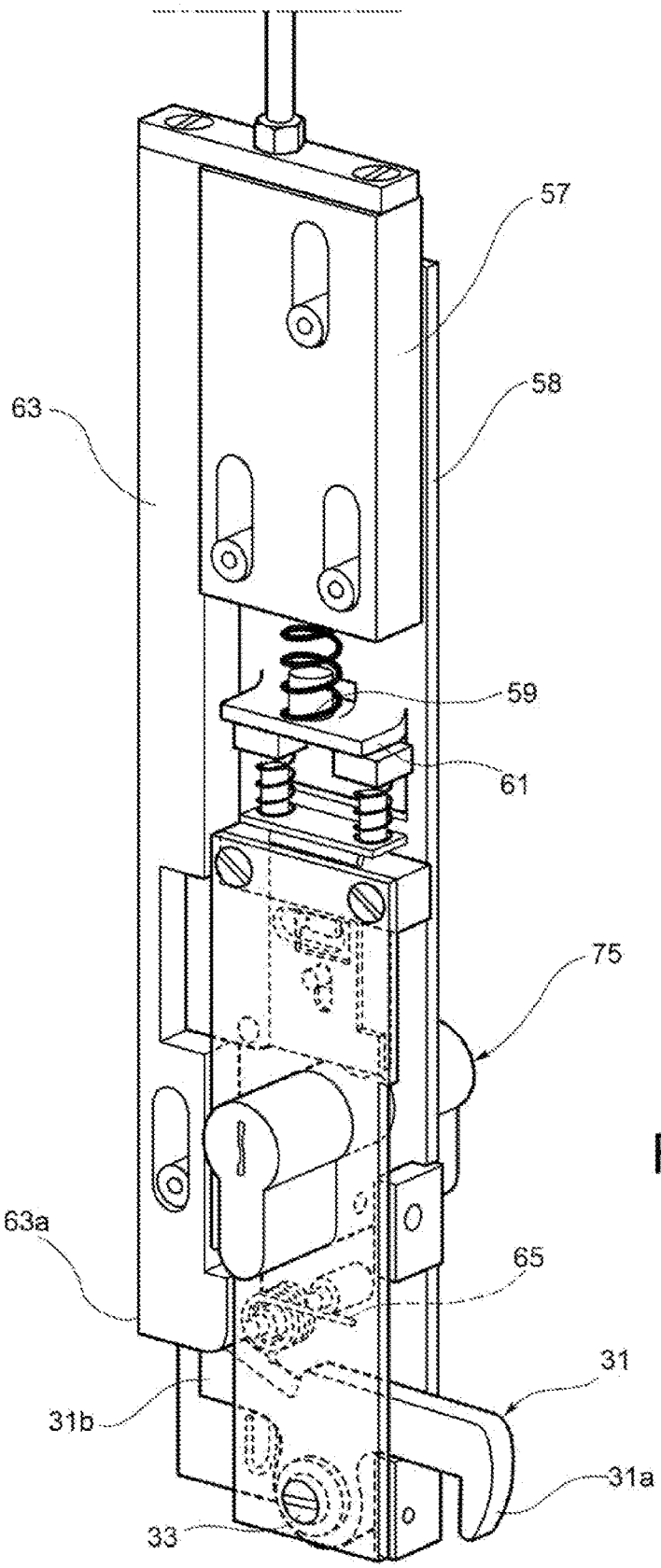
Figure 4:
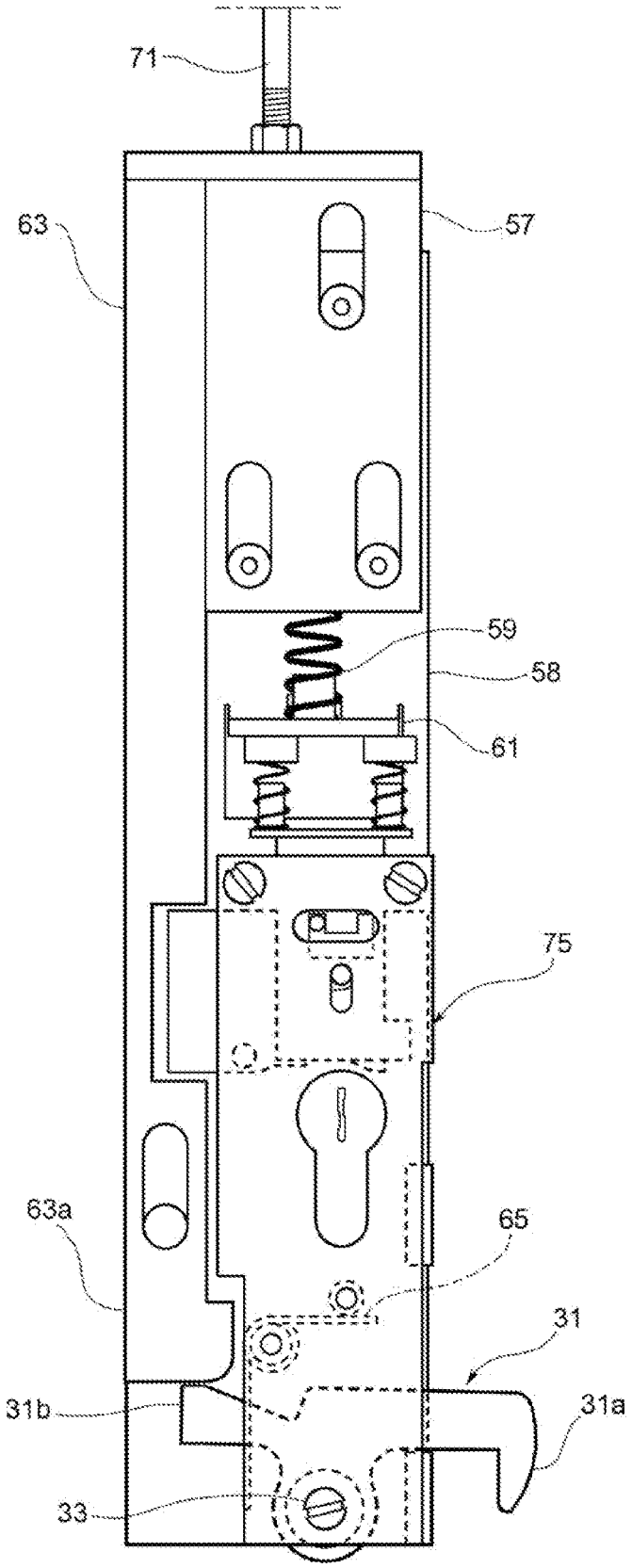
FIG. 4 shows an elevation view of the actuating block in the position shown in FIGS. 2 and 3.
Figure 5:
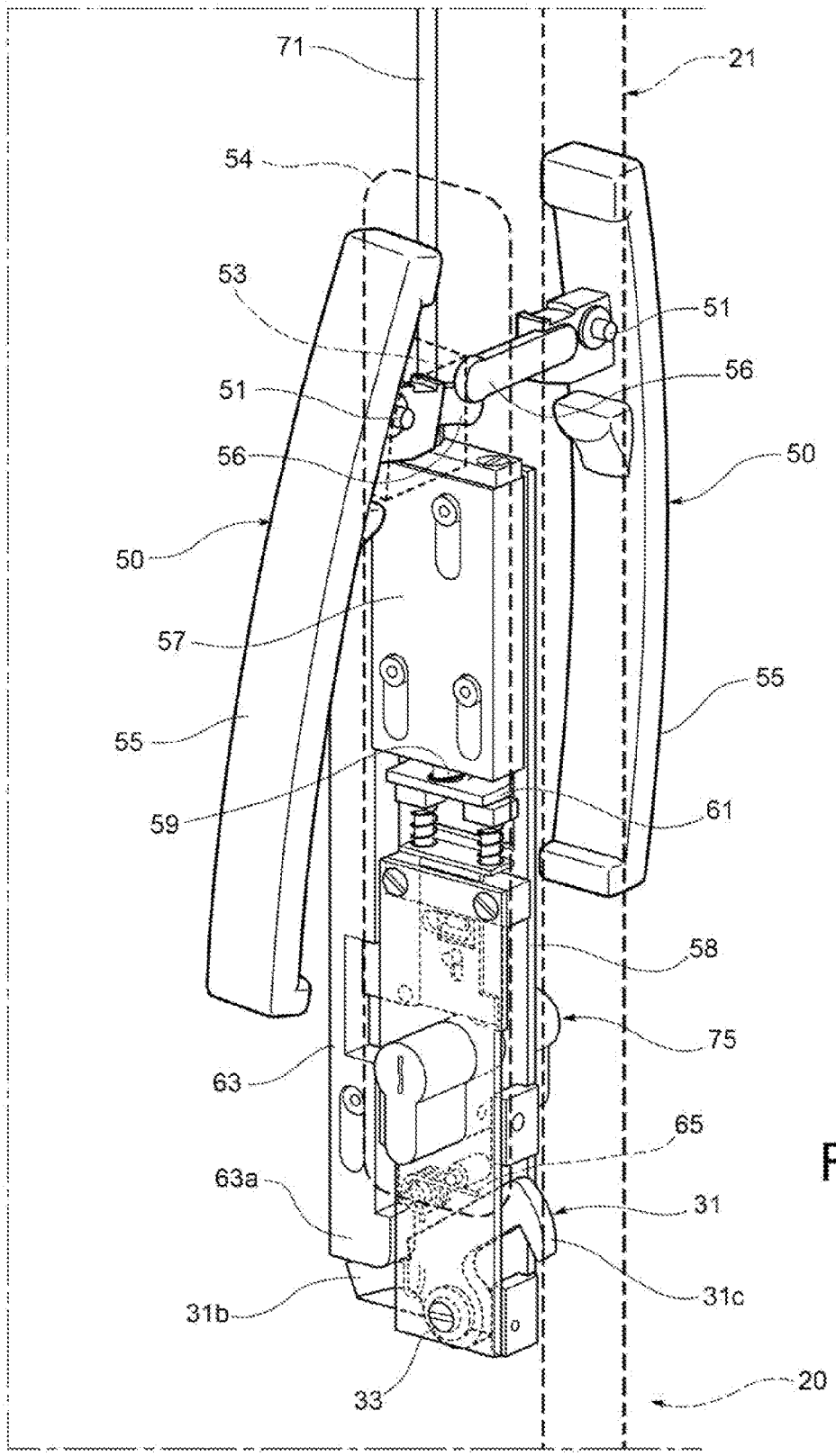
FIGS. 5 and 6 are perspective views of the actuating block of the latching system according to FIG. 1, complete with and without the handles, respectively, in the raised handle position.
Figure 6:
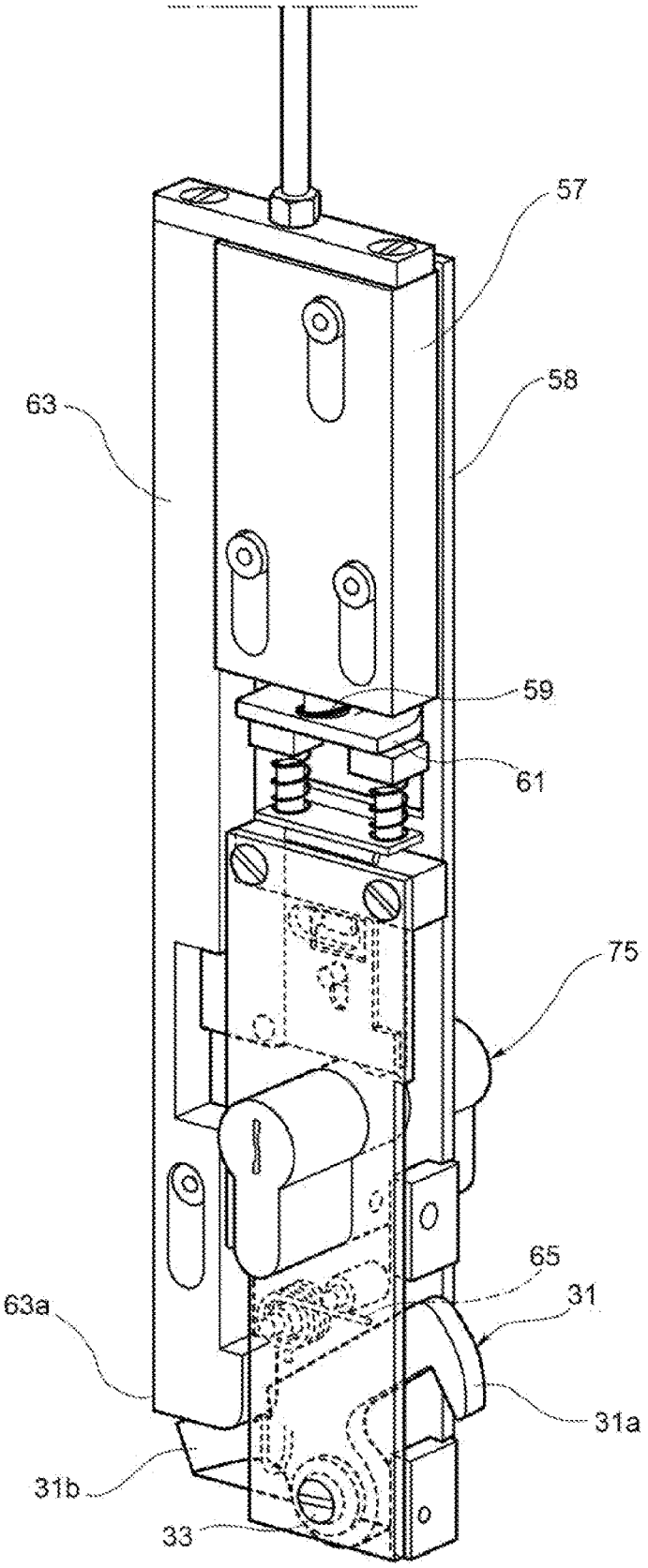
Figure 7:
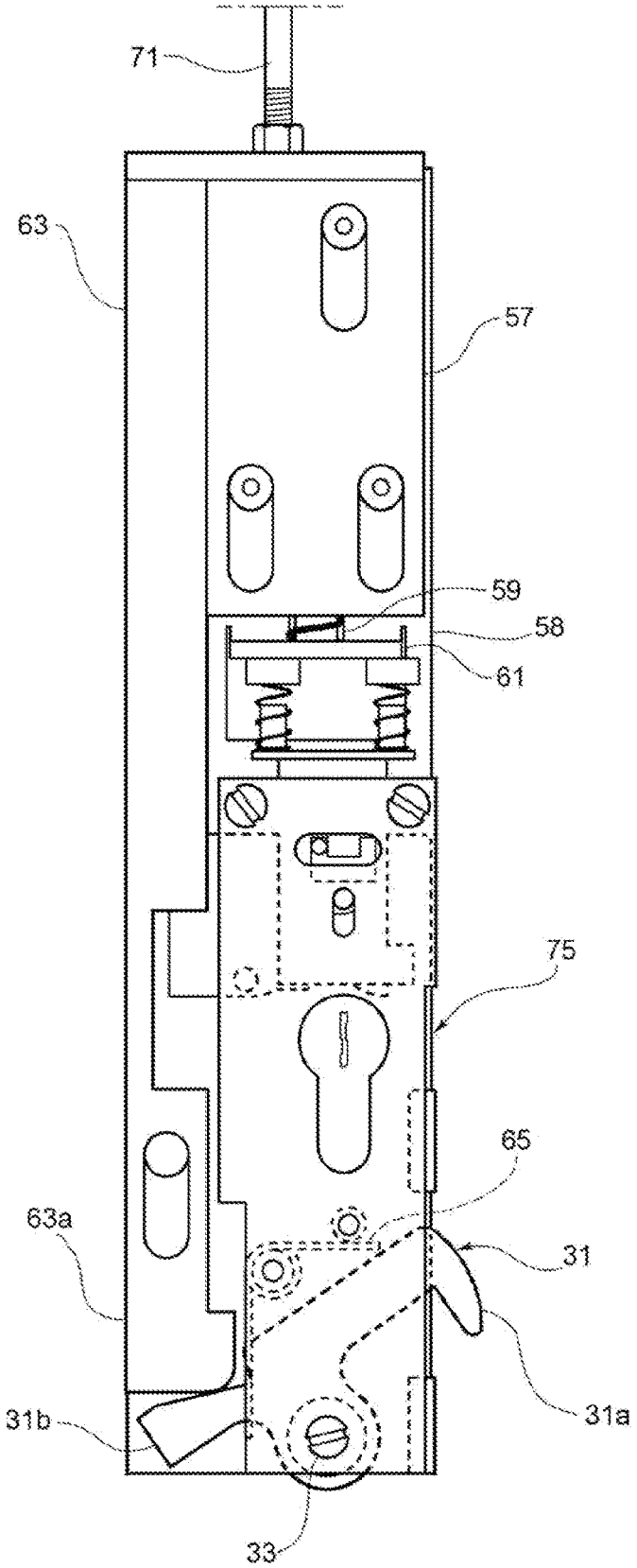
FIG. 7 shows an elevation view of the actuating block in the position shown in FIGS. 5 and 6.

With reference to FIGS. 1 and 2, these show an example of a door or window, denoted overall by 1, realized in the form of a glazed door having a sliding leaf adapted to be mounted on a wall of a room in a boat.

The door or window 1 comprises a main frame 10 adapted to be mounted on the aforementioned wall (not shown) so as to surround an opening formed in said wall, and a leaf 20 mounted on said frame.

Figure 8:
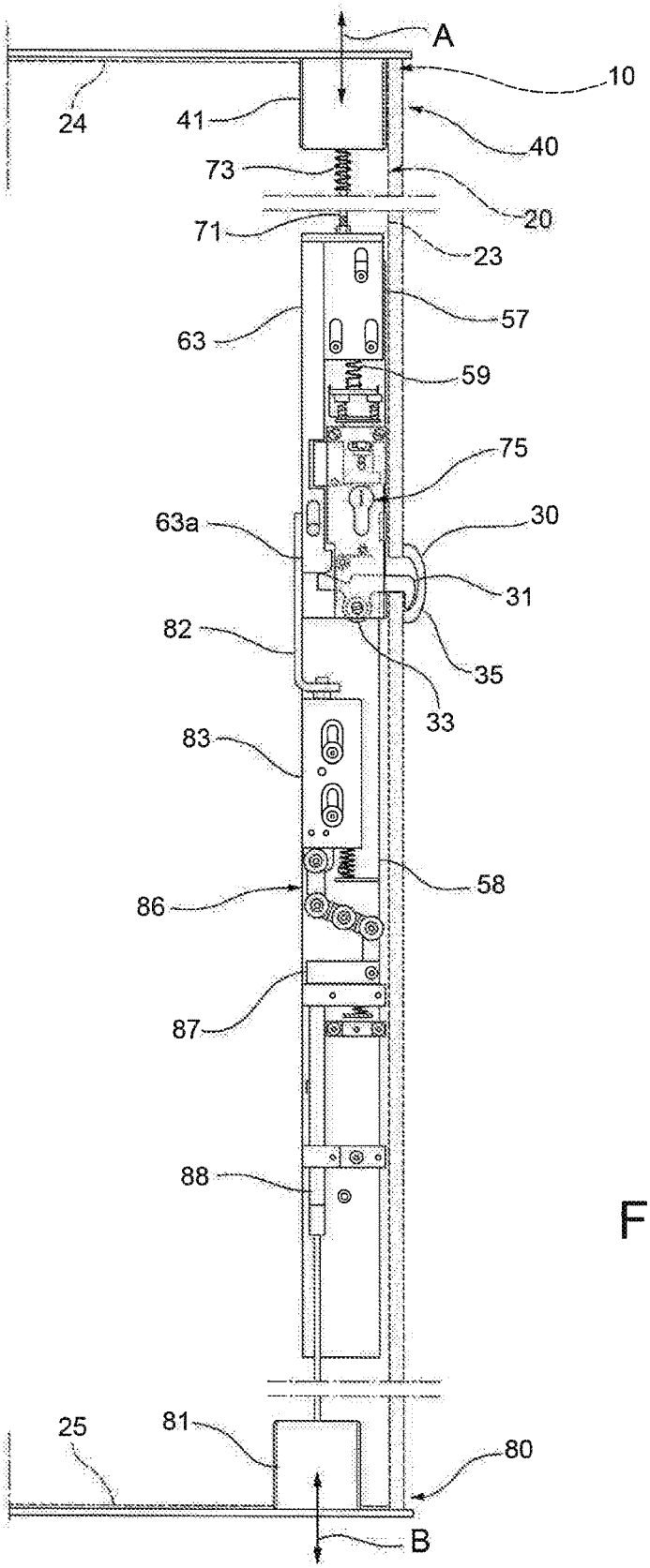
FIG. 8 is a partial view of a door provided with a three-point latching system according to the invention.
Figure 9:
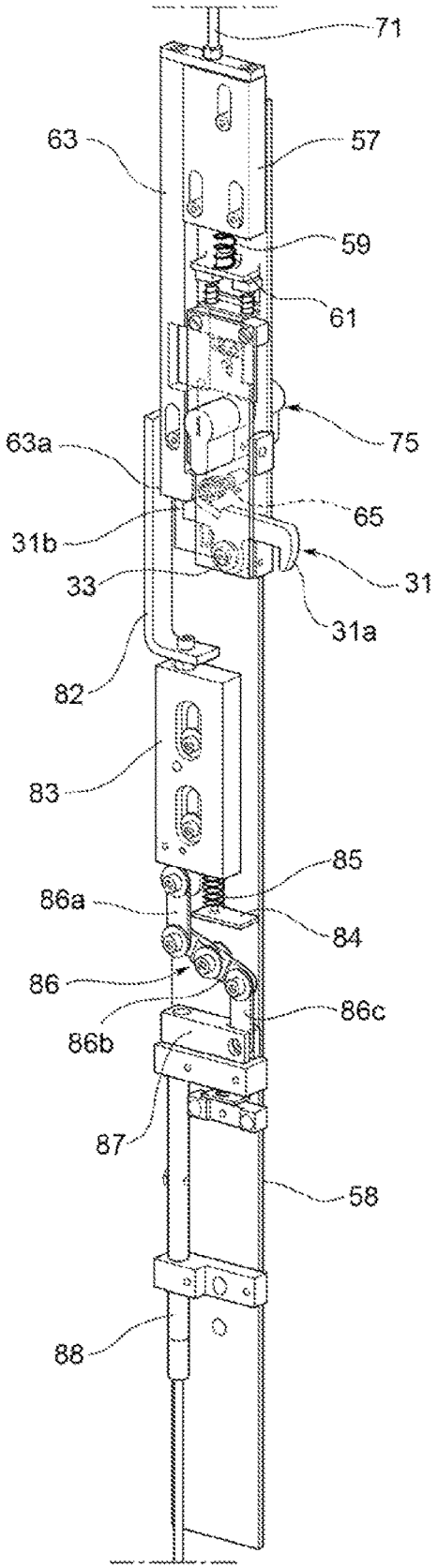
FIGS. 9 and 10 are a perspective view and elevation view, respectively, of the actuating block of the latching system according to FIG. 8, without the handles, in the released handle position.
Figure 10:
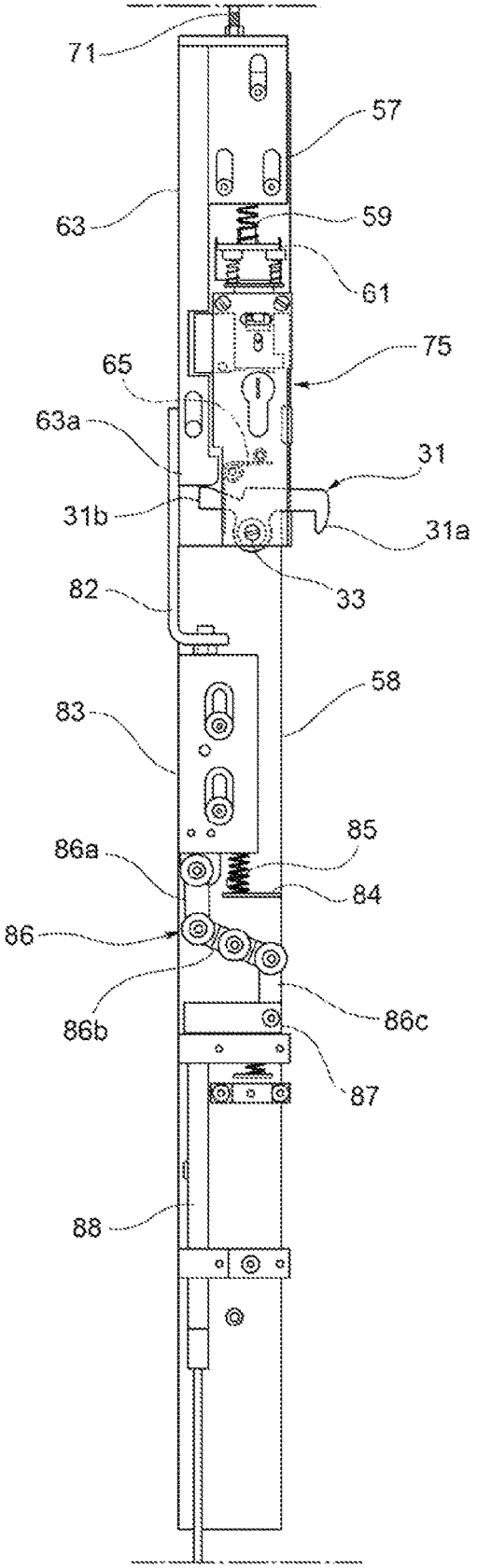
Figure 11:
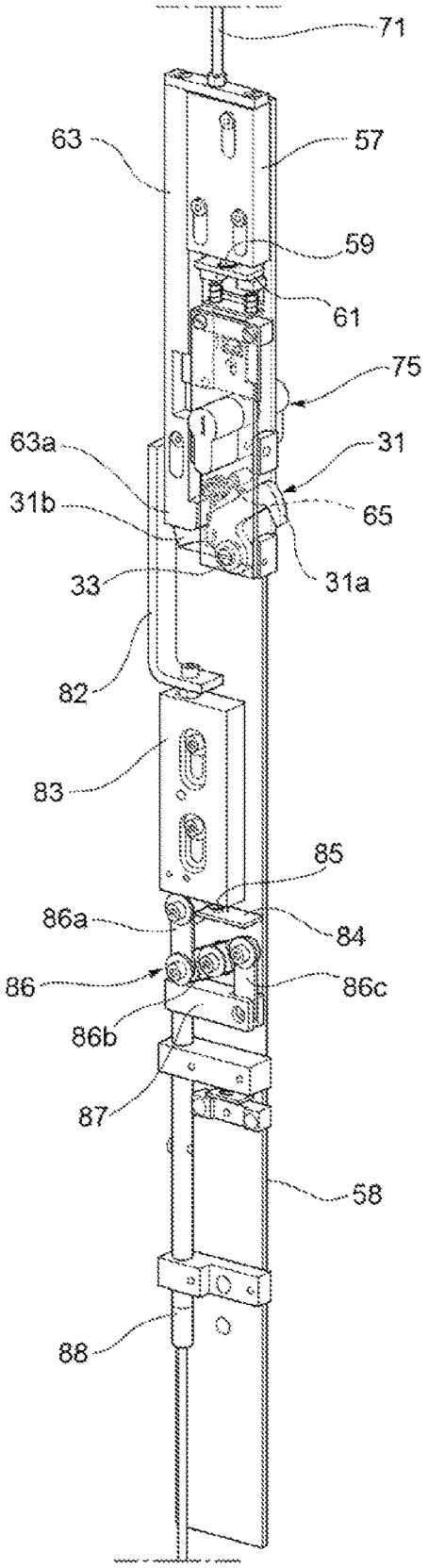
FIGS. 11 and 12 are a perspective view and elevation view, respectively, of the actuating block of the latching system according to FIG. 8, without the handles, in the raised handle position.
Figure 12:
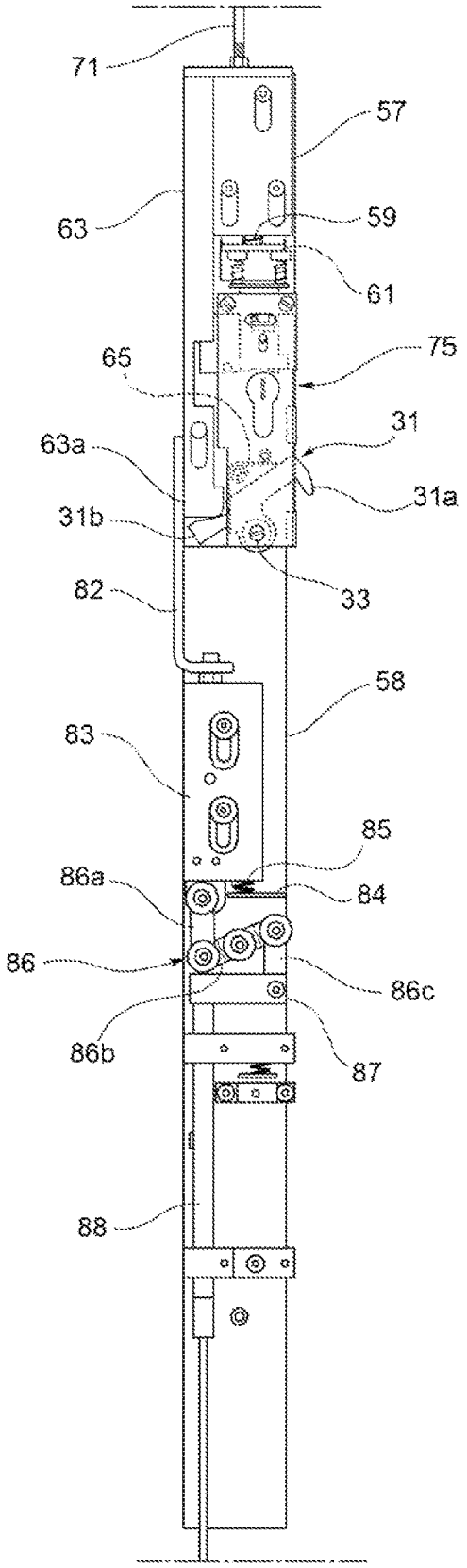

The leaf 20 comprises a pair of uprights, one of which, denoted by 21, is shown in FIG. 2, and a pair of cross-pieces which interconnect these uprights. The leaf 20 therefore has two side edges, one of which, denoted by 23, is shown in FIG. 1, and upper and lower edges 24, 25 (the lower edge is shown in FIG. 8).

The upright 21 has a hollow cross-section, and in its interior is housed a two-point latching system according to the invention, shown more clearly in FIGS. 2 to 7.

The latching system of the door 1 comprises a first snap stop member 30 arranged at the side edge 21 of the leaf 20 of the door or window. The first stop member 30 comprises a pawl 31 rotatable about an axis 33 perpendicular to the plane defined by the leaf 20 (that is, to the plane of FIG. 1) and adapted to engage with a striker element 35 positioned on the main frame 10 of the door or window, so as to lock the leaf 20 when the door is in the closed position.

The latching system further comprises a second snap stop member 40 arranged at the upper edge 24 of the leaf 20. The second stop member 40 comprises a pivot or pin 41 translatable in a vertical direction A and adapted to be inserted inside a seat (not shown) positioned on the main frame 10 of the door or window, so as to lock the leaf 20 when the door is in the closed position (or in other different locked positions, in the case where the leaf is a sliding leaf with the possibility of locking in several positions).

The latching system also comprises a handle 50 (shown in FIG. 2) rotatable so as to control the releasing movement of the first and second stop members 30, 40. The handle 50 is arranged at the side edge 23 of the leaf 20 and is rotatable about a horizontal axis 51 parallel to the plane defined by the leaf 20 (see FIG. 2). In particular, as can be seen in FIG. 2, there are two handles 50 arranged on opposite sides of the leaf 20. Each handle 50 is pivotably mounted on a projection 53 extending perpendicularly from a fixing plate 54 (shown in broken lines in FIG. 2) fixed to the upright 21.

In order to convert the rotation of the handles 50 into a rotation of the pawl 31 and into a translation of the pivot 41, a first and a second transmission mechanism are provided housed inside the upright 21, said mechanisms being described below.

The handles 50 are coupled with the first and second transmission mechanisms independently of each other. Therefore, if one of them is operated to release the latching system, the other one remains fixed in its original position (see FIG. 5) owing to an elastic return element (not shown) associated with it.

Each handle 50 comprises a first and a second lever arm 55, 56; the first lever arm 55 forms a handgrip of the handle 50 and the second lever arm 56 forms an actuating tip adapted to engage with a follower element 57. As can be seen in FIG. 2, the second lever arms 56 of the two handles 50 are arranged alongside each other so as to not to interfere with each other when one of the handles is raised.

The follower element 57 is mounted in a vertically slidable manner on a support plate 58 fixed inside the upright 21. An elastic return element 59, in particular a compression spring, is arranged, in the sliding direction of the follower element 57, between the follower element 57 and a bearing element 61 joined together with the support plate 58. With raising of one of the handles 50, the follower element 57 is pushed to translate downwards by the actuating tip 56 of the handle 50, against the action of the elastic return element 59.

The follower element 57 forms a component common to both the first and the second transmission mechanism.

As regards the first transmission mechanism, the follower element 57 comprises an extension 63 which, in the example shown, is formed by a bar which is fixed to the follower element 57 and extends from the opposite side with respect to the second stop member 41.

The pawl 31 is formed by a rocker arm pivotably mounted on the support plate 58 and having a pawl arm 31*a*, adapted to engage with the striker element 35 positioned on the main frame 10 of the door or window, and en engaging arm 31*b*, adapted to be engaged by a tip 63*a* of the extension 63 of the follower element 57. An elastic return element 65, which, in the example shown, consists of a torsion spring, is associated with the engaging arm 31*b* of the pawl 31.

When the door is brought into the closed position, the pawl 31 engages with a front part of the corresponding striker element 35 on the main frame 10, rising against the action of the elastic return element 65 until it snaps over the front part of the striker element 35.

In order to release the pawl the handles 50 are operated. With raising of one of the handles 50 the follower element 57, and along with it the extension 63, is in fact pushed to translate downwards by the actuating tip 56 of the handle 50. The tip 63*a* of this extension thus engages with the engaging arm 31*b* of the pawl 31 and pushes the pawl to rotate against the action of the elastic return element 65. The pawl arm 31*a* is therefore raised (see FIGS. 5 to 7), disengaging the striker element 35.

The first transmission mechanism for operation of the pawl 31 therefore comprises the tip 56 of the handle 50, the follower element 57, the tip 63*a* of the extension 63 of the follower element 57 and the engaging arm 31*b* of the pawl 31 of the first stop member 30.

As regards the second transmission mechanism, the end of a rod 71 is fixed to the follower element 57, its other end being connected, by means of an elastic return element 73 (in the example a compression spring) to the pivot 41 of the second snap stop member 40.

When the door is brought into the closed position (or another locked position), the pivot 41 is located in correspondence of the respective seat on the main frame 10 and therefore, as a result of the elastic return element 73, snap-engages inside this seat.

In order to release the pivot 41, the handles 50 are operated. With raising of one of the handles 50 the follower element 57, and along with it the rod 71, is in fact pushed to translate downwards by the actuating tip 56 of the handle 50. The pivot 41 of the second snap stop member 40 is therefore lowered, freeing the respective seat on the main frame 10.

The latching system comprises, finally, a lock 75 which can be operated in a per se conventional manner so as to lock the latching system, acting for example on the extension 63 of the follower element 57.

With reference to FIGS. 8 to 12 these show a second example of embodiment of a latching system according to the invention. The same reference numbers have been assigned to elements corresponding to those of the embodiment; these elements will not be further described.

The embodiment shown in FIGS. 8 to 12 differs from the preceding embodiment in that it consists of a three-point latching system.

In particular, in said system a third snap stop member 80 is arranged at the lower edge 25 of the leaf 20. The third stop member 80 comprises a pivot or pin 81 translatable in a vertical direction B and adapted to be inserted inside a seat (not shown) positioned on the main frame 10 of the door or window, so as to lock the leaf 20 when the door is in the closed position (or in other different locked positions, in the case where the leaf is a sliding leaf with the possibility of locking in several positions).

The movement of the pivot 81 of the third snap stop member 80 is performed by means of a third transmission mechanism adapted to convert the rotation of the handle 50 into a translation of the pivot 81. The transmission of the movement from the handle 50 to the pivot 81 of the third stop member takes place starting from the follower element 57, together with actuation of the first stop member 30 and the second stop member 40.

The third mechanism comprises further extension elements 82, 83 which are rigidly connected to the extension 63 of the follower element 57. An elastic return element 85, which in the example is a compression spring, is arranged between the more distal extension element 83 and a bearing part 84 of the support plate 58. The more distal extension element 83 is further connected to a linkage 86 adapted to reverse the direction of movement of the pivot 81 of the third stop member 80 with respect to that of the follower element 57. The linkage 86 comprises a first rod 86*a*, a rocker arm 86*b* and a second rod 86*c*. The first rod 86*a* is hinged at one end to the more distal extension element 83 and at the other end to one end of the rocker arm 86, which is pivotably mounted on the support plate 58 at an intermediate point thereof. The other end of the rocker arm 86*b* is hinged to one end of the second rod 86*c*. The other end of the second rod 86*c* is hinged to a connection element 87, which is rigidly connected to one end of a bar 88. The pivot 81 of the third stop member 80 is fixed to the other end of the bar 88.

When the door is brought into the closed position (or another locked position), the pivot 81 is located correspondence to the respective seat on the main frame 10 and therefore, as a result of the elastic return element 85, snap-engages inside this seat.

In order to release the pivot 41, the handles 50 are operated. With raising of one of the handles 50 the follower element 57, and along with it the extension 63 and the extension elements 83, 83, is in fact pushed to translate downwards by the actuating tip 56 of the handle 50. The linkage 86 therefore causes the upwards movement of the bar 88. The pivot 81 of the third snap stop member 80 is therefore raised (against the action of the elastic return element 85), freeing the respective seat on the main frame 10.

What is claimed is:

1. A latching system for a door or window, the latching system comprising a first snap stop member adapted to be arranged at a side edge of a leaf of the door or window, said first snap stop member comprising a pawl rotatable about an axis perpendicular to a plane defined by the leaf;

a second snap stop member adapted to be arranged at an upper or lower edge of the leaf, said second snap stop member comprising a pivot translationally movable in a vertical direction;

a handle rotatable so as to control the releasing movement of said first and second snap stop members, said handle being adapted to be arranged at the side edge of the leaf and being rotatable about a horizontal axis parallel to the plane defined by the leaf, wherein the handle comprises a first and a second lever arm, the first lever arm forming a handgrip of the handle and the second lever arm forming an actuating tip; and a first and a second transmission mechanism for converting a rotation of the handle into a rotation of the pawl and a translational motion of the pivot, respectively, wherein the first and second transmission mechanisms comprise a follower element mounted in a vertically slidable manner on the leaf, said follower element being adapted to be engaged by the actuating tip of the handle and pushed to translationally move against the action of a first elastic return element, wherein said follower element is adapted to engage the pawl of the first snap stop element and is connected to the pivot of the second snap stop member.

2. The system according to claim 1, wherein said handle is a first handle and said system comprises a second handle, and wherein said first and second handles are adapted to be arranged on opposite sides of the leaf and coupled with the first and second transmission mechanisms independently of each other.

3. The system according to claim 1, wherein the second transmission mechanism comprises the actuating tip of the handle, the follower element and a rod which at one end is fixed to the follower element and at the other end is connected, by means of a second elastic return element, to the pivot of the second snap stop member.

4. The system according to claim 1, wherein the follower element comprises an extension extending from a side of the follower element facing away from the second snap stop member and wherein the pawl of the first snap stop member comprises an engaging arm adapted to be engaged by a tip of the extension of the follower element and pushed to rotate against the action of a third elastic return element and wherein the first transmission mechanism comprises the tip of the handle, the follower element, the tip of the extension of the follower element and the engaging arm of the pawl of the first snap stop member.

5. The system according to claim 1, further comprising a third snap stop member adapted to be arranged at an edge of the leaf opposite to that along which the second snap stop member is arranged, said third snap stop member comprising a pivot translationally movable in a vertical direction; and a third transmission mechanism for converting a rotation of the handle into a translational motion of the pivot of the third snap stop member.

6. The system according to claim 4, further comprising a third snap stop member adapted to be arranged at an edge of the leaf opposite to that along which the second snap stop member is arranged, said third snap stop member comprising a pivot translationally movable in a vertical direction; and a third transmission mechanism for converting a rotation of the handle into a translational motion of the pivot of the third snap stop member, wherein the third transmission mechanism comprises a linkage adapted to reverse the direction of movement of the pivot of the third snap stop member with respect to that of the follower element.

* * * * *